US010633756B2

(12) United States Patent
Kondo et al.

(10) Patent No.: US 10,633,756 B2
(45) Date of Patent: Apr. 28, 2020

(54) PLATED FIBER, CARBON FIBER, WIRE HARNESS AND PLATING METHOD

(71) Applicant: YAZAKI CORPORATION, Tokyo (JP)

(72) Inventors: Hiroki Kondo, Shizuoka (JP); Satoru Yoshinaga, Shizuoka (JP); Yusuke Yoshikawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 127 days.

(21) Appl. No.: 15/085,672

(22) Filed: Mar. 30, 2016

(65) Prior Publication Data

US 2016/0289857 A1 Oct. 6, 2016

(30) Foreign Application Priority Data

Apr. 2, 2015 (JP) ..... 2015-075572
Apr. 2, 2015 (JP) ..... 2015-075573

(51) Int. Cl.
*C25D 5/54* (2006.01)
*C25D 7/06* (2006.01)
(Continued)

(52) U.S. Cl.
CPC ..... *C25D 5/54* (2013.01); *C25D 5/56* (2013.01); *C25D 7/0607* (2013.01); *H01B 1/026* (2013.01);
(Continued)

(58) Field of Classification Search
CPC ..... Y10T 428/294–2958; C25D 5/54; C25D 5/56; C25D 7/0607; C25D 3/38;
(Continued)

(56) References Cited

U.S. PATENT DOCUMENTS 4,518,632 A * 5/1985 Jones ..... D01F 11/127 174/128.2
5,759,711 A 6/1998 Miyabayashi et al.
(Continued)

FOREIGN PATENT DOCUMENTS

CN 1042196 A 5/1990
CN 202549335 U 11/2012
(Continued)

OTHER PUBLICATIONS

R. R Holler, "Metallized Kevlar for Undersea Electromechanical Cables," OCEANS 1984, Washington, DC, USA, 1984, pp. 668-673., doi: 10.1109/OCEANS.1984.1152237.*
(Continued)

*Primary Examiner* — Matthew D Matzek
(74) *Attorney, Agent, or Firm* — Kenealy Vaidya LLP

(57) ABSTRACT

A plated fiber that is obtained by applying a metal plating onto a fiber having an elongation percentage which is more than or equal to 1% and less than or equal to 10%. An elongation percentage of the metal plating is higher than the elongation percentage of the fiber. A carbon fiber wherein the surface oxygen amount as a value obtained by dividing an $O_{1S}$ peak intensity measured by X-ray photoelectron spectroscopy by a $C_{1S}$ peak intensity measured by the spectroscopy is more than or equal to 0.097 and less than or equal to 0.138.

3 Claims, 7 Drawing Sheets

(51) Int. Cl.

| | |
|---|---|
| ***C25D 5/56*** | (2006.01) |
| ***H01B 1/04*** | (2006.01) |
| ***H01B 1/02*** | (2006.01) |
| *H01B 7/00* | (2006.01) |
| *C25D 3/38* | (2006.01) |

(52) U.S. Cl.
CPC ..... *H01B 1/04* (2013.01); *C25D 3/38* (2013.01); *H01B 7/0045* (2013.01)

(58) Field of Classification Search
CPC ..... H01B 1/026; H01B 1/04; H01B 7/0045; H01B 7/17; H05K 9/0098
USPC ... 428/357, 364, 378, 379, 389, 74, 75, 375; 427/372.2, 383.1
See application file for complete search history.

(56) References Cited

U.S. PATENT DOCUMENTS

| | | | | |
|---|---|---|---|---|
| 2002/0064602 | A1 | 5/2002 | Murofushi et al. | |
| 2004/0053049 | A1* | 3/2004 | Tsunashima | C08K 9/02 428/375 |
| 2013/0175089 | A1* | 7/2013 | Hanazaki | H01R 4/06 174/84 R |
| 2013/0333914 | A1* | 12/2013 | Kumada | H05K 9/0098 174/36 |
| 2014/0057127 | A1 | 2/2014 | Kroener | |
| 2018/0209060 | A1 | 7/2018 | Kondo et al. | |

FOREIGN PATENT DOCUMENTS

| | | | |
|---|---|---|---|
| CN | 102899890 | A | 1/2013 |
| CN | 102995396 | A | 3/2013 |
| CN | 103628308 | A | 3/2014 |
| JP | 62-184178 | A | 8/1987 |
| JP | S63-264968 | A | 11/1988 |
| JP | H02-104767 | A | 4/1990 |
| JP | 6-20522 | A | 1/1994 |
| JP | 8-13255 | A | 1/1996 |
| JP | 9-223513 | A | 8/1997 |
| JP | 2000-154460 | A | 6/2000 |
| JP | 2001-316832 | A | 11/2001 |
| JP | 2002-30569 | A | 1/2002 |
| JP | 2002-180379 | A | 6/2002 |
| JP | 2004-146081 | A | 5/2004 |
| JP | 2005-097776 | A | 4/2005 |
| JP | 2007-186823 | A | 7/2007 |
| JP | 2008-130241 | A | 6/2008 |
| JP | 2008-208456 | A | 9/2008 |
| JP | 2009-242839 | A | 10/2009 |
| JP | 2010-70826 | A | 4/2010 |
| JP | 2012-74180 | A | 4/2012 |
| JP | 2012-122164 | A | 6/2012 |
| JP | 2014-13741 | A | 1/2014 |
| JP | 2014-101605 | A | 6/2014 |
| JP | 5517148 | B2 | 6/2014 |
| JP | 2014-150022 | A | 8/2014 |
| JP | 2018-012912 | A | 1/2018 |
| JP | 2018-084020 | A | 5/2018 |

OTHER PUBLICATIONS

Japanese Office Action for the related Japanese Patent Application No. 2015-075573 dated Mar. 9, 2017.
Japanese Office Action for the related Japanese Patent Application No. 2015-075573 dated Jun. 19, 2017.
Japanese Office Action for the related Japanese Patent Application No. 2015-075573 dated Sep. 28, 2017.
Japanese Office Action for the related Japanese Patent Application No. 2015-075572 dated May 24, 2017.
Japanese Office Action for the related Japanese Patent Application No. 2017-158569 dated Sep. 18, 2018.
Chinese Office Action for the related Chinese Patent Application No. 201610203983.8 dated Jun. 1, 2018.
Common Knowledge 1; pp. 175 and 176.
Common Knowledge 2; p. 117.
Japanese Information offer for the related Japanese Patent Application No. 2017-158569 dated Jun. 14, 2018.
Chinese Office Action for the related Chinese Patent Application No. 201610203983.8 dated Jan. 31, 2019.
Japanese Office Action for the related Japanese Patent Application No. 2017-158569 dated Dec. 4, 2018.
Japanese Office Action for the related Japanese Patent Application No. 2017-240120 dated Dec. 4, 2018.

* cited by examiner

PLATED FIBER, CARBON FIBER, WIRE HARNESS AND PLATING METHOD

BACKGROUND

The present invention relates to a plated fiber and a wire harness.

The present invention relates to a carbon fiber, a wire harness, and a plating method.

In recent years, diameter reduction and weight reduction are required of an electric wire so as to enhance the fuel efficiency, and a 0.13 sq electric wire and a 0.35 sq electric wire have been proposed. Such an electric wire is subject to tension during routing on a wiring board at the time of manufacture of a wire harness, and for making it possible to withstand the tension, a copper alloy is used in the conductor part with an attempt to increase the strength.

However, increasing the strength of an electric wire by using a copper alloy is approaching the limit, and it is difficult for an electric wire to achieve greater diameter reduction and greater weight reduction. To solve this problem, a plated fiber obtained by applying plating to a high-strength fiber such as aramid fiber, PBO (poly(p-phenylenebenzobisoxazole)) fiber and polyarylate fiber has been proposed for use as a conductor of an electric wire (see, for example, Patent Documents 1 and 2). In addition, those of which breaking strength or impact load is studied so as to provide a non-breaking electric wire by using a high-strength conductor where a plating layer is provided a high-strength organic synthetic fiber, have been also proposed (see, Patent Documents 3 and 4).

Conventionally, it has been studied to apply a metal plating onto a carbon fiber. However, the carbon fiber has a problem that the wettability with a plating solution is poor and the throwing power and adherence of the metal plating are low. To solve this problem, a method of coating a carbon fiber with an alkaline degreasing solution and thereby adjusting the wettability on the carbon fiber surface has been proposed (see, for example, Patent Document 5).

[Patent Document 1] JP-A-2008-130241 (the term "JP-A" as used herein means an "unexamined published Japanese patent application")

[Patent Document 2] JP-A-2009-242839

[Patent Document 3] Japanese Patent No. 5,517,148

[Patent Document 4] JP-A-2014-150022

[Patent Document 5] JP-A-2007-186823

SUMMARY

An object of the present invention is to provide a plated fiber and a wire harness, where the plating can be prevented from fracture when the fiber is not broken.

An object of the present invention is to provide a carbon fiber, a wire harness, and a plating method, where the plating deposition and adherence can be enhanced without reducing the mechanical strength.

According to the present invention, there is provided a plated fiber obtained by applying a metal plating onto a fiber having an elongation percentage which is more than or equal to 1% and less than or equal to 10%, wherein an elongation percentage of the metal plating is higher than the elongation percentage of the fiber.

In the plated fiber of the present invention, the elongation percentage of the metal plating may be more than or equal to 8.5% and less than or equal to 24.1%.

In the plated fiber of the present invention, a gradient of a tensile load relative to the elongation percentage of the fiber may be greater than a gradient of a tensile load at the time of reaching a maximum elongation percentage in an elastic region of a metal constituting the metal plating, relative to the maximum elongation percentage.

A wire harness of the present invention may have an electric wire using the plated fiber above as a conductor part, the conductor part being coated with an insulator.

A cross-sectional area of the metal plating may be same as a cross-sectional area of the fiber.

A heat treatment may be applied to the metal plating.

According to the present invention, there is provided a carbon fiber, wherein a surface oxygen amount which is a value obtained by dividing an $O_{1S}$ peak intensity measured by X-ray photoelectron spectroscopy by a $C_{1S}$ peak intensity measured by the spectroscopy is more than or equal to 0.097 and less than or equal to 0.138.

A wire harness may have an electric wire using, as a conductor part, a plated fiber obtained by applying a metal plating onto the carbon fiber above, the conductor part being coated with an insulator.

According to the present invention, there is provided a plating method of applying a metal plating onto a carbon fiber, comprising a first step of charging a carbon fiber into a processing tank into which an organic metal complex is not charged, a second step of supplying carbon dioxide adjusted to a supercritical state to the processing tank into which a carbon fiber is charged in the first step, a third step of taking out the carbon fiber from the processing tank after a predetermined time is passed since carbon dioxide adjusted to a supercritical state is supplied in the second step, and a fourth step of applying by electroplating a metal plating onto the carbon fiber taken out in the third step.

In the second step, the carbon dioxide may be adjusted to a pressure of 15 MPa and a temperature of 100 to 200° C. and thereby caused to enter the supercritical state. The predetermined time may be 60 minutes.

BRIEF DESCRIPTION OF DRAWINGS

FIG. 2A illustrates the cross-section of the plated fiber; and FIG. 2B illustrates an electric wire using the plated fiber as a conductor part.

FIG. 7A illustrates the cross-section of the carbon fiber; and FIG. 7B illustrates an electric wire using a plated fiber as a conductor part.

DETAILED DESCRIPTION OF EXEMPLIFIED EMBODIMENTS

In a conventional electric wire, when a tension is applied to a plated fiber, e.g., at the time of manufacture of a wire harness, only the plating that is a metal is fractured while the fiber is not broken, and despite no apparent breakage of the plated fiber, the electric resistance may be increased, leading to a failure in fulfilling the function as an electric wire.

The present invention has been made to solve such a conventional problem, and an object of the present invention is to provide a plated fiber and a wire harness, where the plating can be prevented from fracture when the fiber is not broken.

A preferred embodiment of the present invention is described below by referring to FIGS. 1 to 5. The present invention is not limited to the following embodiment, and appropriate changes can be made therein without departing from the gist.

Figure 1:
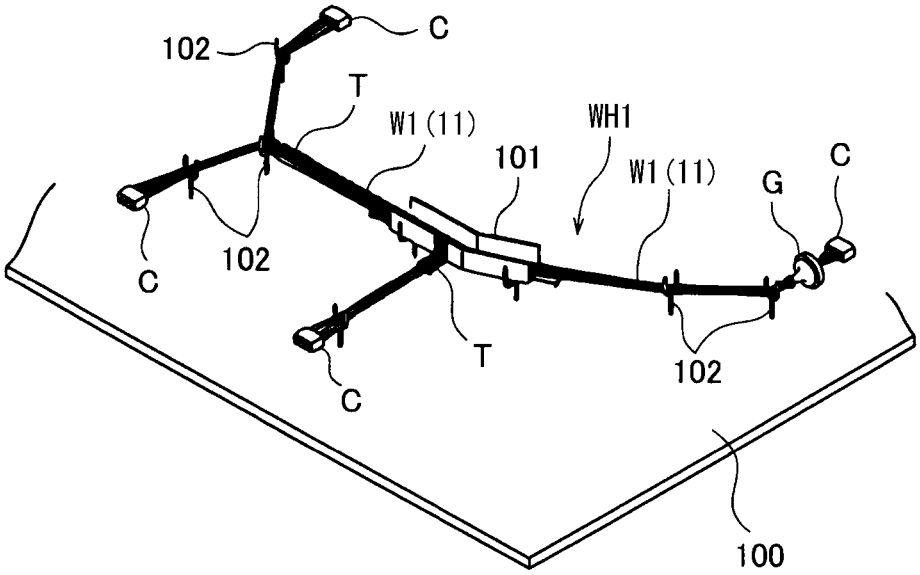
FIG. 1 is a perspective view illustrating the configuration of the wire harness according to an embodiment of the present invention.

FIG. 1 is a cross-sectional view illustrating the configuration of the plated fiber according to an embodiment of the present invention. In FIG. 1, for the sake of convenience of the description, a wiring board is depicted, in addition to a wire harness.

As illustrated in FIG. 1, the wire harness WH1 is composed of a bundle of a plurality of electric wires W1 and forked at a predetermined point, and a connector C is attached to a terminal portion of the electric wire W1. In the wire harness WH1, for example, tape winding T is applied at a specific point or an exterior member 101 such as corrugated tube is fixed. Furthermore, a grommet G is sometimes attached to the wire harness WH1. At least one of the plurality electric wires W1 constituting the wire harness WH1 is an electric wire 11 having the later-described plated fiber.

At the time of manufacture of such a wire harness WH1; a wiring board 100 is used. In the wiring board 100, fork-shaped locking pins 102 are provided so as to determine the route of each electric wire W1 constituting the wire harness WH1. A worker routes a plurality of electric wires W1 on the wiring board 100 by using the locking pins 102, performs tape winding T and, if desired, attaches an exterior member 101 or a grommet G to manufacture a wire harness WH1. In addition, a conduction check is performed on the wire harness WH1 by attaching an inspection member to the connector C.

At the time of such routing of an electric wire W1 on a wiring board 100, a certain tension applies to the electric wire W1. The plated fiber described below is configured such that when it is subject to such a tension, the metal plating is not fractured in advance of breakage of the fiber.

Figure 2A:
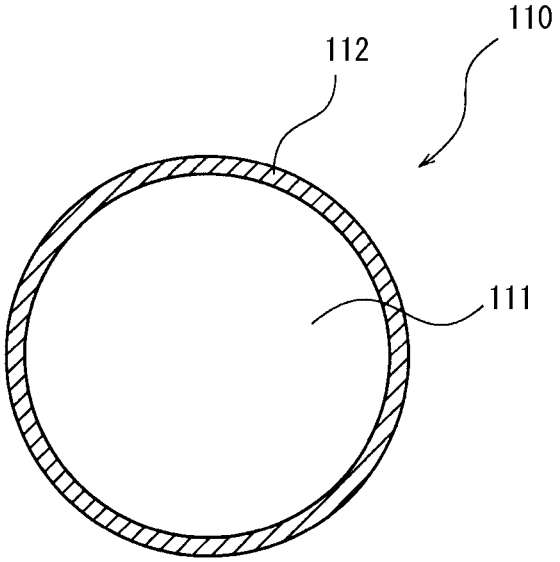
FIGS. 2A and 2B are cross-sectional views illustrating details of the plated fiber according to an embodiment of the present invention.
Figure 2B:
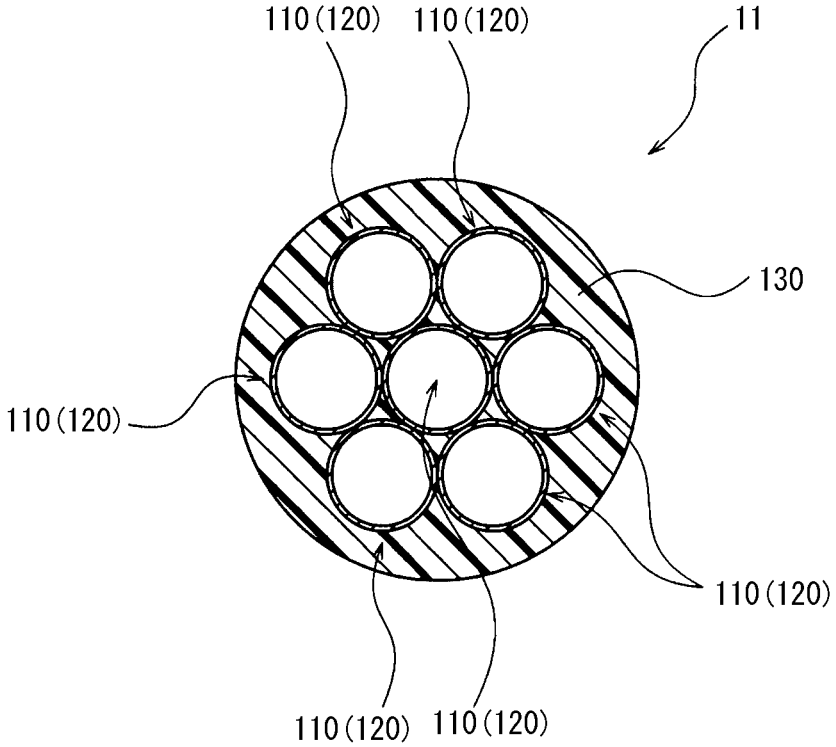

FIGS. 2A and 2B are cross-sectional views illustrating details of the plated fiber according to an embodiment of the present invention; FIG. 2A illustrates the cross-section of the plated fiber; and FIG. 2B illustrates an electric wire using the plated fiber as a conductor part.

As illustrated in FIG. 2A, the plated fiber 110 is obtained by applying a metal plating 112 onto a fiber 111. As for the fiber 111, a fiber material formed by chemical synthesis from a raw material such as petroleum and having a tensile strength at break being more than or equal to 1 GPa and an elongation percentage at break being more than or equal 1% and less than or equal to 10% is employed. Because, if the elongation percentage is less than 1%, the likelihood of bending and breakage of the fiber 111, for example, upon buckling of the electric wire 11 at the time of manufacture of the wire harness WH1 is high. In addition, if the elongation percentage exceeds 10%, the metal plating 112 is also elongated when the fiber is elongated at an elongation percentage of more than 10%, and the metal plating 112 becomes thin, as a result, the electric resistance value is increased by 10% or more, failing in satisfying the specification of the electric wire 11. As the fiber 111, for example, an aramid fiber, a polyarylate fiber, and a PBO fiber are applicable.

The metal plating 112 is a conductive metal and, in this embodiment, is composed of copper (soft copper) that is heat-treated at a temperature not less than a predetermined temperature for a predetermined time or more.

As illustrated in FIG. 2B, the electric wire 11 consists of a conductor part 120 and an insulator 30 applied onto the conductor part 120. The conductor part 120 is composed of a bundle of a plurality of plated fibers 110 illustrated in FIG. 2A.

Such an electric wire 11 using the plated fiber 110 as the conductor part 120 is lightweight and highly strong and moreover, is excellent in the bending resistance, because the inside of the plated fiber 110 is composed of a fiber 111.

Here, in a conventional electric wire, when a tension is applied to a plated fiber, e.g., at the time of manufacture of a wire harness WH1, only the metal plating is fractured and despite no apparent breakage of the plated fiber, the electric resistance may be increased, leading to a failure in fulfilling the function as an electric wire.

To cope with this problem, in the plated fiber 110 according to this embodiment, the elongation percentage (elongation percentage at break) of the metal plating 112 is set to be higher than the elongation percentage (elongation percentage at break) of the fiber 111. Because, thanks to this configuration, the metal plating 112 is elongated more than the fiber 111 when a tension is applied to the plated fiber 110, and the metal plating 112 is prevented from undergoing fracture despite no fiber 111 breakage.

Figure 3:
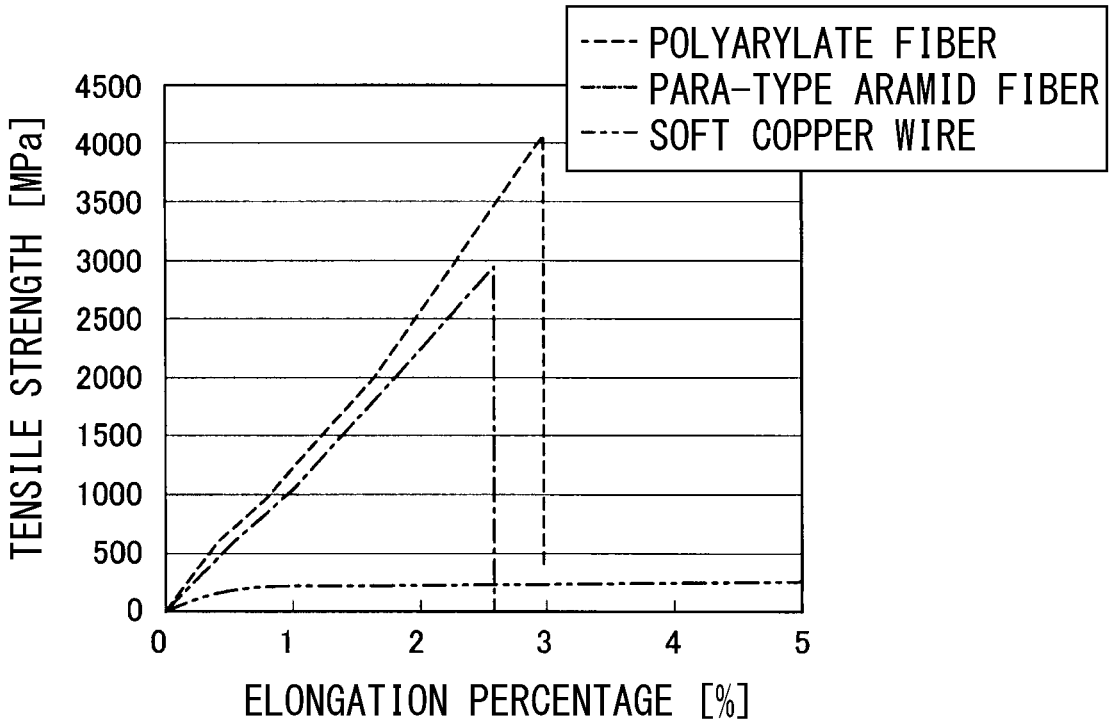
FIG. 3 is a graph illustrating the relationship between the elongation percentage and the tensile strength of each of the fiber and the metal constituting the metal plating.

FIG. 3 is a graph illustrating the relationship between the elongation percentage and the tensile strength of each of the fiber 111 and the metal constituting the metal plating 112. As illustrated in FIG. 3, the tensile strength at break of a para-type aramid fiber as one example of the fiber 111 is just under 3,000 MPa, and the elongation percentage at break there is about 2.7%. Furthermore, the tensile strength at break of a polyarylate fiber as one examples of the fiber 111 is just over 4,000 MPa, and the elongation percentage at break there is about 3.0%.

The fiber 111 is designed to undergo elastic deformation until reaching the elongation percentage at break. More specifically, even if a para-type aramid fiber is elongated by less than about 2.7% due to application of a predetermined tension, when the tension is zeroed, the fiber elastically returns to a state of the elongation percentage being 0%. The same applies to a polyarylate fiber, etc.

The tensile strength at break of soft copper as one example of the metal plating 112 is about 250 MPa, and the elongation percentage at break there is about 20% or more. Here, many metals including soft copper have an elastic region to an elongation percentage of 0.5% or less and a plastic region to an elongation percentage of more than 0.5%. Therefore, even if soft copper is elongated by about 0.5% or less due to application of a predetermined tension, when the tension zeroed, the copper elastically returns to a state of the elongation percentage being 0%. On the other hand, when soft copper is elongated by more than about 0.5% due to application of a predetermined tension, even if the tension is thereafter zeroed, the copper does not elastically return to a state of the elongation percentage being 0% and remains in an elongated state.

Figure 4:
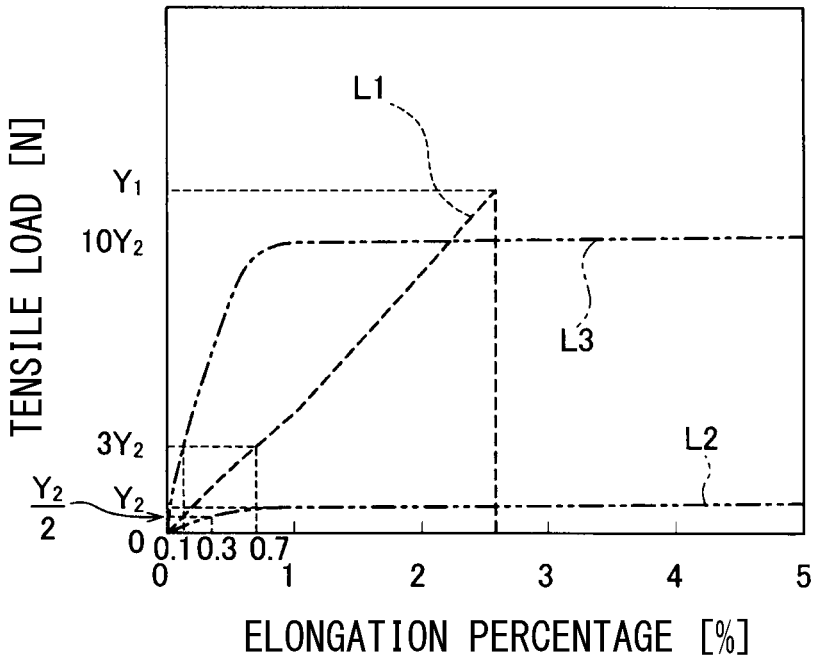
FIG. 4 is a graph illustrating the relationship between the elongation percentage and the tensile load of each of the fiber and the metal constituting the metal plating.

Here, MPa as the unit of tensile strength is known to be a value indicating the tensile load per unit area. FIG. 4 is a graph illustrating the relationship between the elongation percentage and the tensile load of each of the fiber 111 and the metal constituting the metal plating 112.

As illustrate in FIG. 4, in a para-type aramid fiber having a predetermined cross-sectional area, the tensile load at break is Y1, and the elongation percentage at break there is about 2.7% (see, mark L1). Similarly, in soft copper having the same cross-sectional area, the tensile load at break is Y2, and the elongation percentage at break there is about 20% or more. Incidentally, an elongation percentage of 0.5% or less is an elastic region, and an elongation percentage of more than 0.5% is a plastic region (see, mark L2).

In addition, in soft copper having a cross-sectional area of about 10 times that of the soft copper indicated by line L2, the tensile load at break is 10Y2. At this time, the elongation percentage at break is still about 20% or more, and the elastic region is also still 0.5% or less (see, mark L3).

Here, the gradient of the tensile load relative to the elongation percentage at break of line L1 is Y1/2.7 (tensile load/elongation percentage). On the other hand, the gradient of the tensile load at the time of reaching a maximum elongation percentage (i.e., 0.5%) in the elastic region of soft copper indicated by line L2, relative to the maximum elongation percentage, is Y2/0.5 (<Y1/2.7). Similarly, the gradient of line L3 is 10Y2/0.5 (>Y1/2.7).

In the plated fiber 110 according to this embodiment, the above-described gradient of the fiber 111 is adjusted to be larger than the gradient of the metal constituting the metal plating 112 by controlling the fiber 111 diameter, plating thickness, etc. More specifically, in the plated fiber 110 according to this embodiment, those having the cross-sectional area ratio relationship of line L1 and line L2 are preferably employed, and it is preferable not to employ those having the cross-sectional area ratio relationship of line L1 and line L3.

The reason therefor is as follows. For example, a tensile load of about Y2/2 is applied to the plated fiber 110. At this time, when the cross-sectional areas of the fiber 111 and the metal plating 112 are the same as in the cross-sectional area ratio relationship of line L1 and line L2, the fiber 111 governs the tensile load. That is, the elongation percentage of the fiber 111 is about 0.1% relative to the tensile load Y2/2. On the other hand, the elongation percentage of the metal constituting the metal plating 112 is about 0.3% relative to the tensile load Y2/2. Here, since the metal plating 112 is integrated on the fiber 111, an actual plated fiber 110 is not elongated by more than 0.1% relative to the tensile load Y2/2. That is, a load is likely to be applied to the fiber 111 relative to the tensile load Y2/2, and the likelihood of fracture of only the metal plating 112 can be more reduced.

On the other hand, for example, a tensile load of about 3Y2 is applied to the plated fiber 110. At this time, when the cross-sectional area of the metal plating 112 is 10 times the cross-sectional area of the fiber 111 as in the cross-sectional area ratio relationship of line L1 and line L3, the metal plating 112 governs the tensile load. That is, the elongation percentage of the fiber 111 is about 0.7% relative to the tensile load 3Y2. On the other hand, the elongation percentage of the metal constituting the metal plating 112 is about 0.1% relative to the tensile load 3Y2. Here, since the metal plating 112 is integrated on the fiber 111, an actual plated fiber 110 is not elongated by more than 0.1% relative to the tensile load 3Y2. That is, a load is likely to be applied to the metal plating 112 relative to the tensile load 3Y2, and the likelihood of fracture of only the metal plating 112 may be increased.

For the reason above, in this embodiment, the above-described gradient of the fiber 111 is adjusted to be larger than the above-described gradient of the metal constituting the metal plating 112 by controlling the diameter of the fiber 111, and plating thickness, etc.

In the following, Examples of the present invention and Comparative Examples are described. Table 1 is a table showing Examples and Comparative Examples. As shown in Table 1, in Examples 1 to 3 and Comparative Example 1, 80 polyarylate fibers each having thereon a copper plating were bundled, and a tensile load of 15 N was applied to the bundle. The polyarylate fiber had a fiber diameter of 22 μm, a tensile strength (N/fiber) of 1.5, and an elongation percentage at break of 3%. The copper plating of Comparative Example 1 was not subjected to a heat treatment and had a tensile strength (N/fiber) of 2.0 and an elongation percentage at break of 2%. On the other hand, the copper plating of Example 1 was subjected to a heat treatment at 100° C. for a predetermined time and had a tensile strength (N/fiber) of 0.13 and an elongation percentage at break of 8.5%. In Example 2 where a heat treatment at 150° C. for a predetermined time was applied, the tensile strength (N/fiber) was 0.09, and the elongation percentage at break was 15.7%. In Example 3 where a heat treatment at 200° C. for a predetermined time was applied, the tensile strength (N/fiber) was 0.06, and the elongation percentage at break was 24.1%.

TABLE 1

| | Fiber | | | | | Copper Plating | | | | | |
|---|---|---|---|---|---|---|---|---|---|---|---|
| | Kind | Number of Fibers | Fiber Diameter (μm) | Tensile Strength (N/fiber) | Elongation percentage (%) | Tensile Strength (N/fiber) | Elongation percentage (%) | Heat Treatment Temperature (° C.) | Tensile Load (N) | State after Stretching | Bending Test (times) |
| Example 1 | polyarylate fiber | 80 | 22 | 1.5 | 3 | 0.13 | 8.5 | 100 | 15 | no plating crack | — |
| Example 2 | polyarylate fiber | 80 | 22 | 1.5 | 3 | 0.09 | 15.7 | 150 | 15 | no plating crack | — |
| Example 3 | polyarylate fiber | 80 | 22 | 1.5 | 3 | 0.06 | 24.1 | 200 | 15 | no plating crack | — |
| Example 4 | para-type aramid fiber | 270 | 12 | 0.34 | 2.7 | 0.13 | 8.5 | 100 | 15 | no plating crack | 1911000 |
| Example 5 | para-type aramid fiber | 270 | 12 | 0.34 | 2.7 | 0.09 | 15.7 | 150 | 15 | no plating crack | 1956000 |

TABLE 1-continued

| | Fiber | | | | | Copper Plating | | | | | |
|---|---|---|---|---|---|---|---|---|---|---|---|
| | Kind | Number of Fibers | Fiber Diameter (μm) | Tensile Strength (N/fiber) | Elongation percentage (%) | Tensile Strength (N/fiber) | Elongation percentage (%) | Heat Treatment Temperature (° C.) | Tensile Load (N) | State after Stretching | Bending Test (times) |
| Example 6 | para-type aramid fiber | 270 | 12 | 0.34 | 2.7 | 0.06 | 24.1 | 200 | 15 | no plating crack | 1852000 |
| Example 7 | PBO fiber | 270 | 12 | 0.63 | 2.3 | 0.13 | 8.5 | 100 | 15 | no plating crack | — |
| Example 8 | PBO fiber | 270 | 12 | 0.63 | 2.3 | 0.09 | 15.7 | 150 | 15 | no plating crack | — |
| Example 9 | PBO fiber | 270 | 12 | 0.63 | 2.3 | 0.06 | 24.1 | 200 | 15 | no plating crack | — |
| Comparative Example 1 | polyarylate fiber | 80 | 22 | 1.5 | 3 | 0.2 | 2 | none | 15 | cracked in plating | — |
| Comparative Example 2 | para-type aramid fiber | 270 | 12 | 0.34 | 2.7 | 0.2 | 2 | none | 15 | cracked in plating | 594000 |
| Comparative Example 3 | PBO fiber | 270 | 12 | 0.63 | 2.3 | 0.2 | 2 | none | 15 | cracked in plating | — |
| Comparative Example 4 | PET fiber | 410 | 10 | 0.004 | 20 | 0.2 | 2 | none | 15 | broken | — |
| Comparative Example 5 | PET fiber | 410 | 10 | 0.004 | 20 | 0.13 | 8.5 | 100 | 15 | broken | — |
| Comparative Example 6 | PET fiber | 410 | 10 | 0.004 | 20 | 0.09 | 15.7 | 150 | 15 | broken | — |
| Comparative Example 7 | PET fiber | 410 | 10 | 0.004 | 20 | 0.06 | 24.1 | 200 | 15 | broken | — |

In Examples 4 to 6 and Comparative Example 2, 270 para-type aramid fibers each having thereon a copper plating were bundled, and a tensile load of 15 N was applied to the bundle. The para-type aramid fiber had a fiber diameter of 12 μm, a tensile strength (N/fiber) of 0.34, and an elongation percentage at break of 2.7%. The copper plating of Comparative Example 2 was the same as that of Comparative Example 1. Similarly, the copper platings of Examples 4 to 6 are the same as those of Examples 1 to 3.

In Examples 7 to 9 and Comparative Example 3, 270 PBO fibers each having thereon a copper plating were bundled, and a tensile load of 15 N was applied to the bundle. The PBO fiber had a fiber diameter of 12 μm, a tensile strength (N/fiber) of 0.63, and an elongation percentage at break of 2.3%. On the other hand, the copper plating of Comparative Example 3 was the same as that of Comparative Example 1. Similarly, the copper platings of Examples 7 to 9 are the same as those of Examples 1 to 3.

Furthermore, in Comparative Examples 4 to 7, 410 PET (polyethylene terephthalate) fibers each having thereon a copper plating were bundled, and a tensile load of 15 N was applied to the bundle. The PET fiber had a fiber diameter of 10 μm, a tensile strength (N/fiber) of 0.004, and an elongation percentage at break of 20%. The copper plating of Comparative Example 4 was the same as that of Comparative Example 1. Similarly, the copper platings of Comparative Examples 5 to 7 are the same as those of Examples 1 to 3.

Figure 5:
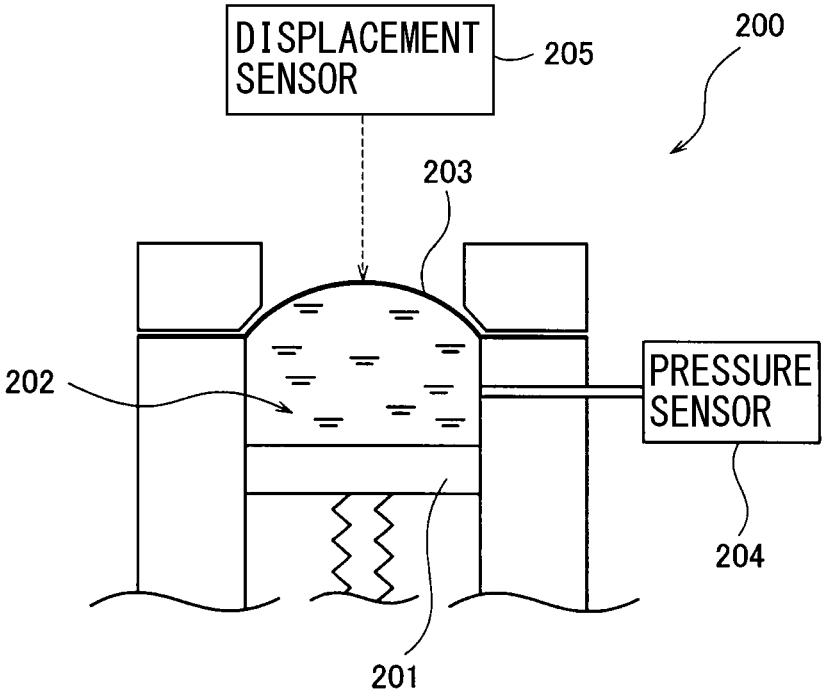
FIG. 5 is a schematic view illustrating a hydraulic bulge tester.

The elongation percentage of the copper plating was measured using the hydraulic bulge tester illustrated in FIG. 5. FIG. 5 is a schematic view illustrating a hydraulic bulge tester. As illustrated in FIG. 5, the hydraulic bulge tester 200 is a tester indicated in ISO 8401. In the hydraulic bulge tester 200, when a piston 201 is at the lowest position, a cylinder 202 is filled with water. A copper foil 203 is placed on the cylinder 202 and fixed. Thereafter, the piton 201 moves upward, and the pressure and the height of the copper foil 203 are detected every 0.1 seconds. The pressure is detected by a pressure sensor 204 connected to the cylinder 202, and the height of the copper foil 203 is detected by a displacement sensor 205 provide on the side opposite the cylinder 202 across the copper foil 203. By this operation, the relationship of the elongation percentage of the copper foil 203 relative to the pressure is clarified. Finally, the copper foil 203 is fractured, whereby the test is finished. The elongation percentage at brake of the copper foil 203 here corresponds to the elongation percentage of the copper plating above.

When a tensile load of 15 N was applied to each of the copper-plated fibers of Examples 1 to 9 and Comparative Examples 1 to 7, plating crack was not observed in all of Examples 1 to 9. On the other hand, plating crack was observed in all of Comparative Examples 1 to 3. Furthermore, in Comparative Examples 4 to 7, the fiber itself could not withstand the tensile load of 15 N and was broken. This is considered to result because even when 410 PET fibers each having a tensile strength per fiber of 0.004 (N/fiber) are bundled, the tensile load of 15 N greatly surpasses 0.004 (N/fiber)×410 (fibers)=1.64 N.

In this way, in Examples 1 to 9 where the elongation percentage at break of copper plating is higher than the elongation percentage at break of each fiber, plating crack was not observed, and it was understood that fracture of a plating when the fiber is not broken can be prevented.

Furthermore, as shown in Table 1, a bending test was performed for Examples 4 to 6 and Comparative Example 2. In the bending test, using a cylindrical mandrel bending tester, each of the copper-plated fibers of Examples 4 to 6 and Comparative Example 2 was repeatedly bend at a predetermined bend radius, and the number of reciprocal bendings until reaching an increase in the resistance value of the copper-plated fiber by 10% of that before the start of the bending test was measured. In the above, bending was repeated such that a bending strain of 0.5% was applied to the copper-plated fiber.

As shown in Table 1, the result was 1,911,000 in Example 4, 1,956,000 in Example 5, and 1,852,000 in Example 6. On the other hand, the number of bendings was 594,000 in Comparative Example 2. Furthermore, the same bending test as above was performed on a soft copper wire having a diameter nearly equal to that of the copper-plated fiber bundles of Examples 4 to 6 and Comparative Example 2, as a result, the number of reciprocal bendings until reaching an increase by 10% of that before the start of the bending test was 302,330.

From these results, it is understood that the bending resistance is far higher in Examples 4 to 6 than in Comparative Example 2. In the above, the bending resistance test was performed only for Examples 4 to 6 and Comparative Example 2, but it is expected that when the bending resistance test is performed for Examples 1 to 3 and Comparative Example 1 and on Examples 7 to 9 and Comparative Example 3, the bending resistance is similarly far higher in respective Examples than in respective Comparative Examples. Furthermore, as apparent from Table 1 and the results above, with respect to Examples 4 to 6 and Comparative Example 2, the bending resistance was found to be higher than that of the soft copper wire.

As verified above, according to the plated fiber 110 of this embodiment, the elongation percentage (elongation percentage obtained by the measurement method in conformity with ISO 8401 using a hydraulic bulge tester 200) of the metal plating 112 is higher than the elongation percentage of the fiber 111 and therefore, when a tension is applied to the plated fiber 110, the metal plating 112 is more elongated than the fiber 111. Accordingly, in the case where the plated-fiber 110 is stretched, fracture of the metal plating 112 does not occur in advance of breakage of the fiber 111, and the metal plating 112 can be prevented from fracture when the fiber 111 is not broken.

The elongation percentage of the metal plating 112 is specified to be more than or equal to 8.5% and less than or equal to 24.1%, so that fracture of the metal plating 112 when the fiber 111 is not broken can be prevented and moreover, a plated fiber 110 excellent also in the bending resistance can be provided.

In addition, the gradient of the tensile load at break relative to the elongation percentage at break of the fiber 111 is greater than the gradient of the tensile load at the time of reaching a maximum elongation percentage in the elastic region of the metal plating 112, relative to the maximum elongation percentage. Thanks to this configuration, when a tension is applied to the plated fiber 110, the tension is likely to apply onto the fiber 111 portion, so that the tension can be prevented from being intensively applied onto the metal plating 112 to cause fracture.

The wire harness WH1 according to the present invention has an electric wire 11 using the above-described plated fiber 110 as a conductor part 120, the conductor part 120 being coated with an insulator 30, so that it can be prevented to provide a wire harness WH1 having an electric wire 11 in which a metal plating 112 fractures due to a tension applied during routing on a wiring board 100 at the time of manufacture and in turn, the electric resistance increases.

In the foregoing pages, the present invention has been described with reference to an embodiment, but the present invention is not limited to the above-described embodiment, and changes can be added thereto without departing from the gist of the present invention.

For example, in the embodiment above, a tension-resistant fiber such as aramid fiber, polyarylate fiber and PBO fiber is recited as examples of the fiber 111, but the present invention is not limited thereto and is of course applicable also to other fibers having an elongation percentage being more than or equal to 1% and less than or equal to 10%.

Furthermore, the present invention is not limited to a case where a plurality of plated fibers 110 are bundled and used as a conductor part 120 and the conductor part 120 is coated with an insulator 30 to manufacture an electric wire 11, and it may be also possible to prepare a plurality of bundles each obtained by bundling a plurality of plated fibers 110, twist these bundles at a predetermined pitch to serve as a conductor part 120, and coat the conductor part 120 with an insulator 30, thereby manufacturing an electric wire 11.

According to the present invention, a plated fiber and a wire harness, where the plating can be prevented from fracture when the fiber is not broken, can be provided.

As for the carbon fiber where wettability is adjusted by the method described in Patent Document 5, the throwing power (plating deposition) and adherence of a plating may be improved, but the mechanical strength is reduced by an alkali.

The present invention has been made to solve such a conventional problem, and an object of the present invention is to provide a carbon fiber, a wire harness, and a plating method, where the plating deposition and adherence can be enhanced without reducing the mechanical strength.

A preferred embodiment of the present invention is described below by referring the drawings. The present invention is not limited to the following embodiment, and appropriate changes can be made therein without departing from the gist.

Figure 6:
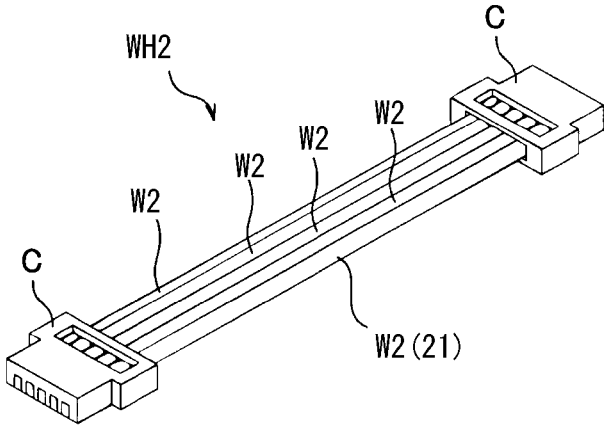
FIG. 6 is a wire harness containing the carbon fiber according to an embodiment of the present invention.

FIG. 6 is a wire harness including a carbon fiber according to the embodiment of the present invention. As illustrated in FIG. 6, in the wire harness WH2, a plurality of electric wires W2 are bundled, and at least one of the plurality electric wires W2 is an electric wire 21 containing a carbon fiber described in detail below. The wire harness WH2 may have, as illustrated in FIG. 6, a connector C at both ends of the electric wire W2 or may be tape-wound (not shown) to gather up the plurality of electric wires W2. In addition, the wire harness WH2 may have an exterior component (not shown) such as corrugated tube.

Figure 7A:
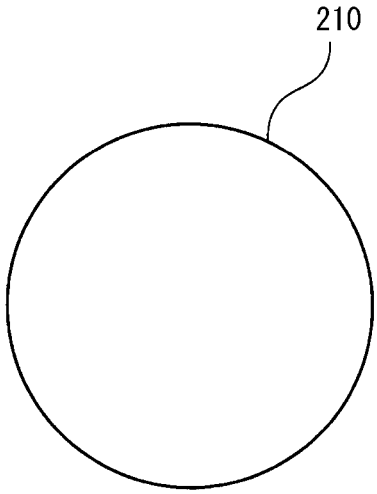
FIGS. 7A and 7B are cross-sectional views illustrating the details of the carbon fiber according to an embodiment of the present invention.
Figure 7B:
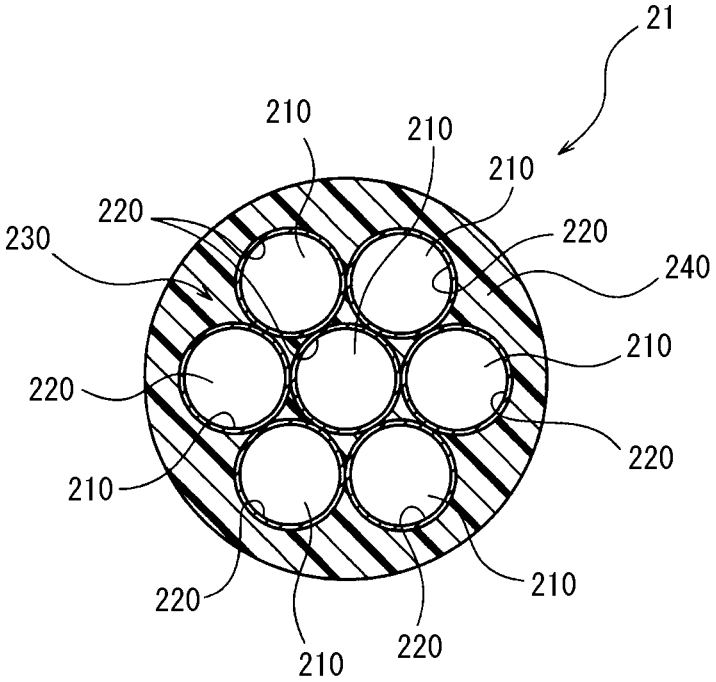

FIGS. 7A and 7B are cross-sectional views illustrating the details of the carbon fiber according to an embodiment of the present invention; FIG. 7A illustrates the cross-section of the carbon fiber; and FIG. 7B illustrates an electric wire using a plated fiber as a conductor part.

As illustrated in FIG. 7A, the carbon fiber 210 is a fiber obtained by using an acrylic fiber or a pitch (by-product such as petroleum, coal, and coal tar) as the raw material and subjecting the material to high-temperature carbonization. Such a carbon fiber 210 has a conductive property and therefore, can be used for a signal line, etc., but in the case of lacking in conductivity, as illustrated in FIG. 7B, a metal plating 220 is sometimes applied. The metal plating 220 for supplementing the conductivity is preferably a copper plating, but the copper exhibits low wettability with the carbon fiber 210 and even when electroplating is performed, the plating deposition and adherence are poor.

To cope with this problem, the carbon fiber 210 employed in this embodiment is a carbon fiber exposed to carbon dioxide in a supercritical state and differs in the surface oxygen amount from conventional carbon fibers. Here, the surface oxygen amount as used in this embodiment is a value obtained by dividing an $O_{1S}$ peak intensity measured by X-ray photoelectron spectroscopy by a $C_{1S}$ peak intensity measured by the same spectroscopy ($O_{1S}/C_{1S}$). As the carbon fiber 210 surface is more oxidized, the $O_{1S}$ peak intensity measured X-ray photoelectron spectroscopy is higher and in turn, the value of the surface oxygen amount tends to be larger.

In this connection, it is known that the number of surface oxygen atoms and the number of acidic functional groups are increased substantially at the same rate. In addition, the acidic functional group is considered to contribute to the interfacial adhesion. In the carbon fiber 210 according to this embodiment, the surface oxygen amount is from 0.097 to 0.138. Because, if the surface oxygen amount falls below 0.097, the adhesion to copper is extremely reduced, whereas if the surface oxygen amount exceeds 0.138, the surface oxygen of the carbon fiber 210 inhibits the contact with a power feeding part at the time of electroplating and a current can hardly flow to the carbon wire 10, resulting in poor plating deposition.

As illustrated in FIG. 7B, in the wire harness WH2 according to this embodiment, a plurality of plated fibers each obtained by applying a metal plating 220 onto a carbon fiber 210 are bundled to construct a conductor part 230. The conductor part 230 is coated with an insulator 240 to manufacture the above-described electric wire 21. In FIG. 7B, the number of plated fibers is 7, but the number of plated fibers is not particularly limited to 7 and, for example, 100 or more plated fibers may be bundled. Furthermore, a plurality of fibers after adding the above-described carbon fiber 210 or a carbon fiber different therefrom (i.e., a carbon fiber of which surface oxygen amount is out of the range above) to the plated fiber obtained by applying a metal plating 220 onto a carbon fiber 210 may be bundled to construct the conductor part 230.

Figure 8:
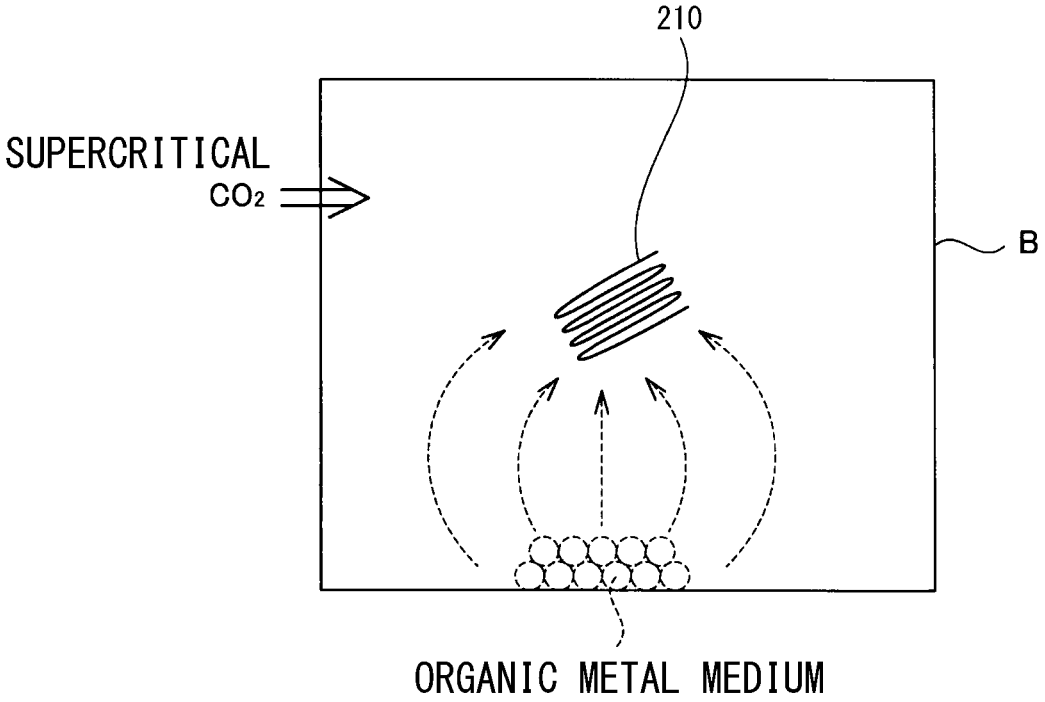
FIG. 8 is a schematic view for explaining the plating method according to an embodiment of the present invention.

The plating method according to this embodiment is described below. FIG. 8 is a schematic view for explaining the plating method according to this embodiment. In order to obtain a plated fiber used for the conductor part 230 in this embodiment, a carbon fiber is first charged into a processing tank B (first step). In this embodiment, an organic metal complex is not charged into the processing tank B in the first step. Because, even if an organic metal complex is not charged into the processing tank B, predetermined plating deposition and adherence can obtained.

Next, carbon dioxide adjusted to a supercritical state is supplied to the processing tank B into which a carbon fiber is charged (second step), and after a predetermined time is passed since carbon dioxide adjusted to a supercritical state is supplied, the carbon fiber is taken out from the processing tank B (third step), whereby the above-described carbon fiber 210 having a surface oxygen amount being more than or equal to 0.097 and less than or equal to 0.138 can be obtained.

Thereafter, so-called electroplating is performed to apply a metal plating 220 (copper plating) onto the carbon fiber 210 (fourth step).

In the following, Examples and Comparative Examples are described. Table 2 is a table showing Examples and Comparative Examples. Here, a PAN-based carbon fiber having a fiber diameter 7 μm was used as the carbon fiber. With respect to Example 10 shown in Table 2, the supercritical conditions of carbon dioxide were a pressure of 15 MPa, a temperature of 100° C., and a time of 60 minutes; with respect to Example 11; the supercritical conditions of carbon dioxide were a pressure of 15 MPa, a temperature of 130° C., and a time of 60 minutes; with respect to Example 12, the supercritical conditions of carbon dioxide were a pressure of 15 MPa, a temperature of 150° C., and a time of 60 minutes; and with respect to Example 13, the supercritical conditions of carbon dioxide were a pressure of 15 MPa, a temperature of 200° C., and a time of 60 minutes.

TABLE 2

| | Processing Conditions | | | Electroplating | | | | Surface Analysis | Mechanical Properties Carbon Fiber | Structural Analysis Raman | | |
|---|---|---|---|---|---|---|---|---|---|---|---|---|
| | Temperature ° C. | Pressure Mpa | Time Min | Voltage V | Current A | Plating Deposition | Sticking Force | XPS $O_{1S}/C_{1S}$ | Strength N/fiber | G/D Ratio | Half-Width | Peak Shift |
| Comparative Example 8 | | | | 2.0 | 0.40 | B | B | 0.159 | 0.2 | 0.93 | 111.5 | 1581.0 |
| Example 10 | 100 | 15 | 60 | 2.0 | 0.57 | A | A | 0.138 | 0.2 | 0.93 | 110.3 | 1583.2 |
| Example 11 | 130 | 15 | 60 | 2.0 | 0.65 | A | A | 0.123 | 0.2 | 0.90 | 110.7 | 1582.9 |
| Example 12 | 150 | 15 | 60 | 2.0 | 0.60 | A | A | 0.103 | 0.2 | 0.92 | 110.5 | 1580.0 |
| Example 13 | 200 | 15 | 60 | 2.0 | 0.52 | A | A | 0.097 | 0.2 | 0.92 | 111.7 | 1584.7 |

With respect to Examples 10 to 13 having passed through the above-described supercritical treatment and Comparative Example 8 not subjected to the supercritical treatment, electroplating was performed to apply a copper plating onto the carbon fiber, In Table 2, as regards the plating deposition, "A" indicates that a good result was obtained, and "B" indicates that unevenness was observed and a non-good result was obtained. As regards the sticking force, "A" indicates that separation of the plating did not occur during water washing after plating, and "B" indicates that separation of the plating occurred during water washing after plating.

First, the surface oxygen amount was 0.138 in Example 10, 0.123 in Example 11, 0.103 in Example 12, and 0.097 in Example 13. In all of these Examples 10 to 13, the plating deposition was "A", and the sticking force was also "A". On the other hand, the surface oxygen was 0.159 in Comparative Example. In Comparative Example 8, the plating deposition was "B", and the sticking force was also "B". Here, as shown in Table 2, the voltage at the time of performing electroplating was set to 2.0 V in Examples 10 to 13 and Comparative Example 8. The current value was 0.57 A in Example 10, 0.65 A in Example 11, 0.60 A in Example 12, 0.52 A in Example 13, and 0.40 A in Comparative Example 8.

It was understood from these results that when a copper plating is applied onto a carbon fiber having a surface oxygen amount of 0.097 to 0.138, good results are obtained and the plating deposition and adherence can be enhanced.

Furthermore, as shown in Table 2, the carbon fibers according to Examples 10 to 13 and Comparative Example 8 were measured for the strength (N/fiber) and analyzed for the structure by Raman spectrometric method. Here, as to the strength, a tensile test of a single fiber in conformity with JIS R 7606 was performed, and the results of measurement of the tensile strength at breakage are shown. In the Raman spectrometric method, the carbon fiber was irradiated with a laser having a wavelength of 532 nm so as to confirm the Raman spectrum, and the results of measurement on the G/D ratio, half-width and peak shift of the obtained Raman spectrum are shown. A higher value of G/D ratio indicates higher crystallinity. In addition, the half-width is a value indicating the integrity of crystal, and the peak shift is a value indicating the distortion of atomic arrangement.

As shown in Table 2, with respect to Examples 10 to 13 and Comparative Example 8, the strength of the carbon fiber was 0.2 N/fiber. In this way, the same value was achieved, and no difference was recognized in the mechanical strength.

Furthermore, with respect to Examples 10 to 13 and Comparative Example 8, the G/D ratio was from 0.90 to 0.93, the half-width was from 110.3 to 111.5, and the peak shift was from 1,580 to 1,584.7. That is, a large difference was not recognized in these values, as well.

As above, the carbon fiber showed neither structural change nor reduction in the mechanical strength depending on the presence or absence of supercritical treatment (i.e., irrespective of whether the surface oxygen amount is more than or equal to 0.097 and less than or equal to 0.138 or not).

Accordingly, the carbon fibers according to Examples 10 to 13 were revealed to be capable of enhancing the plating deposition and adherence without reducing the mechanical strength.

In this way, the present inventors have found that in the carbon fiber 210 according to this embodiment, when the surface oxygen amount is more than or equal to 0.097 and less than or equal to 0.138, the wettability with a metal plating is improved and the plating deposition and adherence can be enhanced. Therefore, in the carbon fiber 210 according to this embodiment, the surface oxygen amount is specified to the range above, whereby the plating deposition and adherence can be enhanced. Moreover, since it is sufficient if the surface oxygen amount is adjusted to the range above, an alkali need not be used, and reduction in the mechanical strength can also be suppressed. In turn, a carbon fiber 210 capable of enhancing the plating deposition and adherence without reducing the mechanical strength can be provided.

In addition, the wire harness WH2 according to this embodiment has an electric wire 21 using, for the conductor part 230, a plated fiber obtained by applying a metal plating 220 onto the above-described carbon fiber 210, the conductor part 230 being coated with an insulator 240, so that a wire harness WH2 having an electric wire 21 including a conductor part 230 composed of a plated fiber appropriately treated with a metal plating 220 and kept from reduction in the mechanical strength can be provided.

Furthermore, the present inventors have found that in the plating method according to this embodiment, when a carbon fiber 210 is exposed to carbon dioxide adjusted to a supercritical state, the surface oxygen amount of the carbon fiber 210 can be changed and the surface oxygen amount can be made to fall in a range being more than or equal to 0.097 and less than or equal to 0.138. In turn, it has been found that in the plating method according to the present invention, where a carbon fiber 210 having a surface oxygen amount in the range above is produced in the first to third steps and electroplating is thereafter performed in the fourth step, a metal plating 220 can be advantageously applied onto the carbon fiber 210. Accordingly, a plating method capable of applying an appropriate metal plating while enhancing the plating deposition and adherence without reducing the mechanical strength can be provided.

According to the present invention, a carbon fiber, a wire harness, and a plating method, where the plating deposition and adherence can be enhanced without reducing the mechanical strength, can be provided.

In the foregoing pages, the present invention has been described with reference to an embodiment, but the present invention is not limited to the above-described embodiment, and changes can be added thereto without departing from the gist of the present invention.

What is claimed is:

1. A plated fiber obtained by applying a metal plating onto a fiber having an elongation percentage which is more than or equal to 1% and less than or equal to 10%, wherein an elongation percentage of a metal constituting the metal plating is higher than the elongation percentage of the fiber, a gradient of a tensile load relative to the elongation percentage of the fiber is greater than a gradient of a tensile load at the time of reaching maximum elongation percentage in an elastic region of the metal constituting the metal plating, relative to the maximum elongation percentage, after applying the metal plating onto the fiber, the metal plating is subjected to a heat treatment at a temperature of more than or equal to 100° C. and less than 200° C. for a predetermined period of time yielding the elongation percentage of the metal constituting the metal plating of more than or equal to 8.5% and less than 24.1%, and the fiber is a para-type aramid fiber or polyarylate fiber.

2. A wire harness comprising an electric wire using the plated fiber according to claim 1 as a conductor part, the conductor part being coated with an insulator.

3. A method for producing the plated fiber according to claim 1, comprising:

applying a heat treatment to the metal plating.

* * * * *